US006439006B1

(12) United States Patent
Tsai

(10) Patent No.: US 6,439,006 B1
(45) Date of Patent: Aug. 27, 2002

(54) COMBINATION LOCK

(75) Inventor: Cheng-Tao Tsai, Tainan (TW)

(73) Assignee: Jaeyou Co., Ltd., Tainan (TW)

( * ) Notice: Subject to any disclaimer, the term of this patent is extended or adjusted under 35 U.S.C. 154(b) by 0 days.

(21) Appl. No.: 09/717,245

(22) Filed: Nov. 22, 2000

(51) Int. Cl.[7] ..... E05B 37/06
(52) U.S. Cl. ..... 70/28; 70/312; 70/233
(58) Field of Search ..... 70/22, 24–28, 70/30, 312, 209, 233

(56) References Cited

U.S. PATENT DOCUMENTS 4,610,152 A * 9/1986 Duringer ..... 70/30
4,621,509 A * 11/1986 Mizuno ..... 70/26
4,671,088 A * 6/1987 Jeang ..... 70/312
4,732,021 A * 3/1988 Su ..... 70/312
4,860,561 A * 8/1989 Hwang ..... 70/28
4,885,923 A * 12/1989 Nakai ..... 70/312 X
4,896,517 A * 1/1990 Ling ..... 70/30 X
5,042,277 A * 8/1991 Jenn-Rong ..... 70/28
5,235,831 A * 8/1993 Lauria et al. ..... 70/312 X
5,277,042 A * 1/1994 Tobias ..... 70/209
5,345,798 A * 9/1994 Nakai ..... 70/312 X
5,531,082 A * 7/1996 Wolk et al. ..... 70/312 X
5,555,753 A * 9/1996 Matlock ..... 70/209
5,560,232 A * 10/1996 Chen ..... 70/30
5,638,708 A * 6/1997 Hsu ..... 70/312 X
5,661,991 A * 9/1997 Hsu ..... 70/312
5,868,012 A * 2/1999 Chun-Te et al. ..... 70/30
5,906,124 A * 5/1999 Su ..... 70/312
5,924,313 A * 7/1999 Kuo ..... 70/26
6,029,481 A * 2/2000 Lai ..... 70/25
6,058,744 A * 5/2000 Ling ..... 70/28

* cited by examiner

*Primary Examiner*—Suzanne Dino Barrett
(74) *Attorney, Agent, or Firm*—Rosenberg, Klein & Lee

(57) ABSTRACT

A combination lock has a keyless lock main body mounted on a housing part, a toothed rod, an engaging rod, a turnable rod and a locking rod. The toothed rod has engaging teeth, and is passed into numeral discs of the lock main body such that the toothed rod is released to be movable, and fixed in a locked position by the numeral discs. The toothed rod has a protruding plate on an outer end. The engaging rod is passed through the housing part, and has a front engaging end, and an intermediate recessed portion. The turnable rod is passed into the lock main body, and the housing part with a semicircular lower end pushing block connecting the recessed portion. The turnable rod has an intermediate portion having a flat side. The protruding plate abuts the flat side to prevent the turnable rod from turning in the locked position. In the unlocked position, the turnable rod is turned for the pushing block to move the engaging rod rearwards. Thus, the engaging end disengages from the locking rod for same to be removable from the locked object.

4 Claims, 5 Drawing Sheets

COMBINATION LOCK

BACKGROUND OF THE INVENTION

The present invention relates to a combination lock which is unlocked by turning the numeral discs to a present combination of numbers.

Combination locks of the above feature are very popular because the user only has to remember a combination of numbers for unlocking the lock, and does not have to carry a key, thereby avoiding the risk of losing the key.

Referring to FIG. 9, a conventional combination lock has a male member 10 and a female member 20. The male member 10 has a toothed rod 101 having engaging teeth 102 spaced apart on an upper side. The female member 20 has a receiving tube 201, several numeral discs 202 and locating washers 203.

The receiving tube 201 has a slot on an upper side for permitting the engaging teeth 102 to be passed through when the engaging teeth 102 to be passed through when the toothed rod 101 of the male member 10 is inserted into the female member 20.

The numeral discs 202 are each connected to a corresponding one of the locating washers 203. The numeral discs 202 are turnably passed through the receiving tube 201, and each has an unlocking number corresponding to a gap formed on an inner side of the numeral disc 202. A C-shaped ring 204 is fitted to the fixing trench 205 to confine the numeral discs 202.

The numeral discs 202 have to be turned to an unlocking position according to the unlocking numbers, forming a passage above the slot of he receiving tube 201 for the engaging teeth 102 to disengage from the numeral discs 202. Thus, the male member 10 can be separated from the female member 20 to unlock the combination lock.

The male member of the conventional lock usually connects a cable for use on a bicycle. However, the conventional lock is found to have a very limited use, unable to be used with a steering wheel lock of a car which has a long and thick locking rod or with a motorcycle lock having an U-shaped locking rod. Consequently, steering wheel locks and motorcycle lock still have to be used with conventional keys, unable to provide users with the convenience of keyless unlocking.

SUMMARY OF THE INVENTION

Therefore, it is a main object of the present invention to provide a keyless combination lock which has wide variety of uses.

The combination lock of the present invention includes a lock main body having several turnable numeral discs; the numeral discs can be turned to an unlocking position according to the preset combination of unlocking numbers;

a toothed rod passed into the lock main body; the toothed rod has engaging teeth on an upper side separably engaging the numeral discs such that the toothed rod is movable when the main body is in the unlocking position; the toothed rod has a separating wall on an outer end and a protruding plate on the wall;

a housing part fixed receiving the lock main body; the housing part has a second through hole perpendicular to the toothed rod;

an engaging rod passed into the second through hole; the engaging rod has a front engaging end and an intermediate recessed portion; the engaging rod is biased forwards by a spring to engage a toothed locking rod passed through the housing part from the engaging end;

a turnable rod passed through the lock main body and the housing part with a lower semi-circular pushing block disposed on the engaging rod recessed part; the turnable rod has an intermediate portion having a flat side; the flat side abuts the protruding plate of the toothed rod when the lock is in the locked position, preventing the turnable rod from turning; the pushing block pushes the engaging rod rearwards for the engaging end to disengage from the toothed locking rod when the lock is unlocked and the turnable rod turns.

The locking rod can be made into various shapes for different purposes, including an elongated one suitable for a steering wheel lock, and an U-shaped one suitable for a motorcycle lock.

BRIEF DESCRIPTION OF THE DRAWINGS

This invention will be better understood by referring to the accompanying drawings, wherein.

DESCRIPTION OF THE PREFERRED EMBODIMENTS

Figure 1:
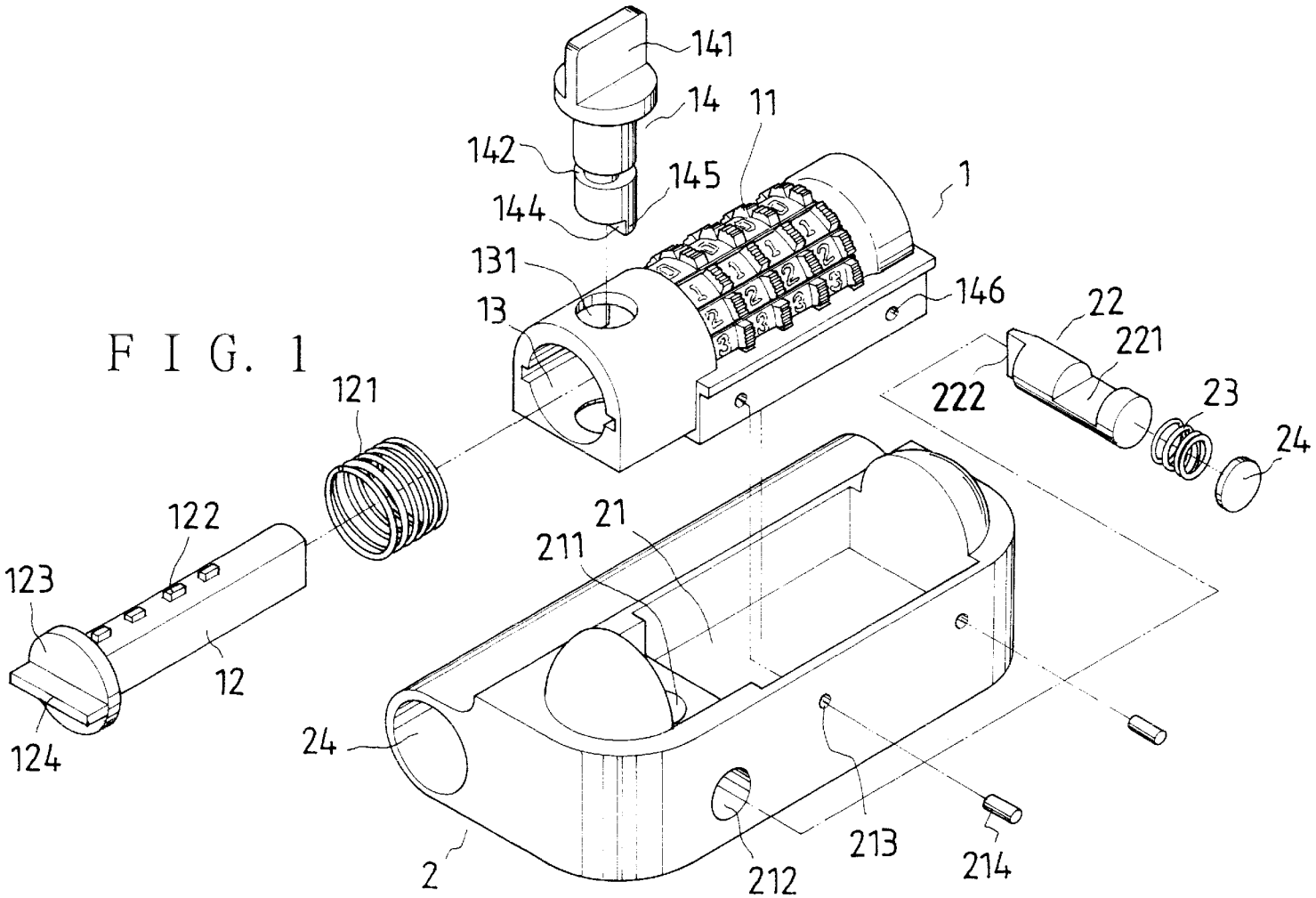
FIG. 1 is an exploded perspective view of the combination lock of the present invention.

Referring to FIG. 1, a combination lock of the present invention includes a lock main body 1, a toothed rod 12, a turnable rod 14, an engaging rod 22 and a housing part 2.

The lock main body 1 has several turnable numeral discs 11, a receiving room 13 on an outer end portion, and through holes 131 in communication with the receiving room 13. The numeral discs 11 each has a gap 111 on an inner side; the gaps 111 each corresponds to an unlocking number of the numeral disc 11.

The toothed rod 12 has engaging teeth 122 spaced apart on an upper side, a separating wall 123 on an outer end, and a protruding plate 124 on the separating wall 123. The toothed rod 12 is passed into the numeral discs 11 with the separating wall 123 received in the receiving room 13 of the lock main body 1; an elastic member 121 is disposed adjacent to an inner side of the separating wall 123 to bias the toothed rod 12 outwardly.

The numeral discs 11 are each turned according to the corresponding unlocking number for the gaps 111 to form a passage permitting the engaging teeth 122 of the toothed rod 12 to move therethrough. Thus, the toothed rod 12 can be moved in the main body 1.

The housing part 2 has a holding room 21, a first hole 211, a second through hole 212, a locking rod hole 24 and pin holes 213. The main body 1 holding the toothed rod 12 is disposed in the holding room with the through holes 131 aligned with the first hole 211. Fixing pins 214 are inserted into the pin holes 213 of the housing part 2, and pin holes 146 of the main body 1 to fix main body 1 to the housing part 2. The second through hole 212 is formed in communication with, and perpendicular to the first hole 211.

The engaging rod 22 has an engaging end 222 at a front end, and a recessed portion 221 on an intermediate portion. The engaging rod 22 is passed into the second through hole 212 with the recessed portion 221 facing up. A spring 23 is disposed on a rear end of the engaging rod 23, and a confining cap 24 is secured to an outer end of the second hole 212 such that the engaging rod 22 is biased forwards.

Figure 2:
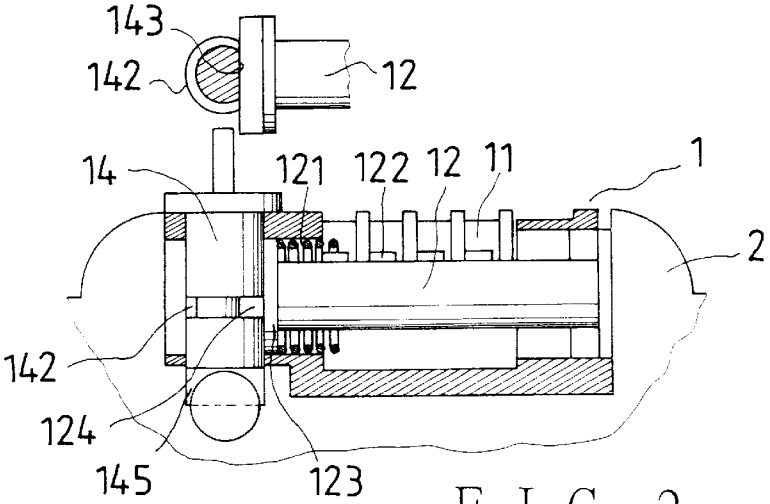
FIG. 2 is a cross-sectional view of the combination lock in FIG. 1 in a locked position.

The turnable rod 14 has an operated part 141 on an upper end, an annular groove 142 on an intermediate portion, a lower end gap 144, a pushing block 145 and a flat side 143 on the intermediate portion (FIG. 2). The pushing block 145 is substantially semi-circular. The turnably rod 14 is passed through the first hole 211 of the housing part 2 with the operated part 141 sticking out from the housing part 2. The protruding plate 124 is fitted onto the annular groove 142 of the turnable rod 14. The pushing block 145 of the turnable rod 14 is received in the recessed portion 221 of the engaging rod 22.

Figure 3:
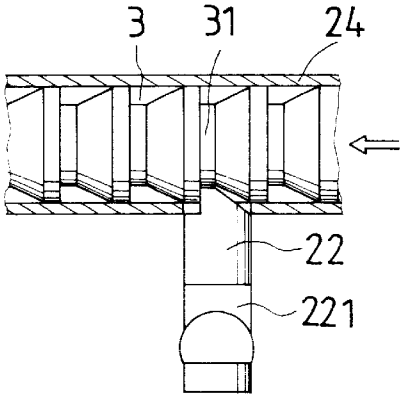
FIG. 3 is a view of the locking rod, and the engaging rod of the combination lock of the present invention in a locked position.

When the lock is locked, referring to FIGS. 2 and 3, the toothed rod 12 is fixed in position by the numeral discs 11, the protruding plate 124 of the toothed rod 12 abutting the flat side 143 of the turnable rod 14 to stop the turnable rod 14 from turning. And, the pushing block 145 of the turnable rod 14 faces a rear lateral side of the recessed portion 221 from a flat side for permitting the engaging rod 22 to be biased forwards to a locking position. Referring to FIG. 3 again, a locking rod 3 of a steering wheel lock is passed into the locking rod hole 24 of the housing part 2 with locking teeth 31 engaging the engaging end 222 of the engaging rod 22. Thus, the locking rod 3 is fixed in a locked position.

Figure 4:
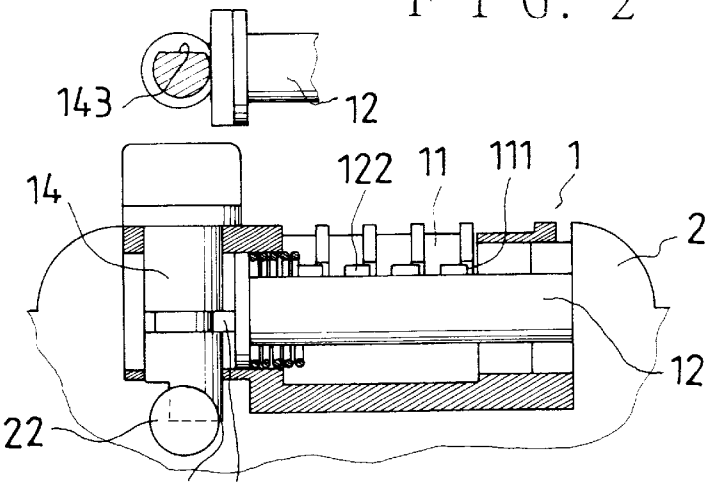
FIG. 4 is a cross-sectional view of the combination lock in FIG. 1 in an unlocked position.
Figure 5:
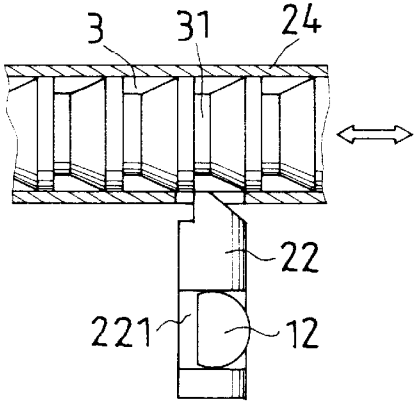
FIG. 5 is a view of the locking rod, and the engaging rod of the combination lock of the present invention in an unlocked position.
Figure 6:
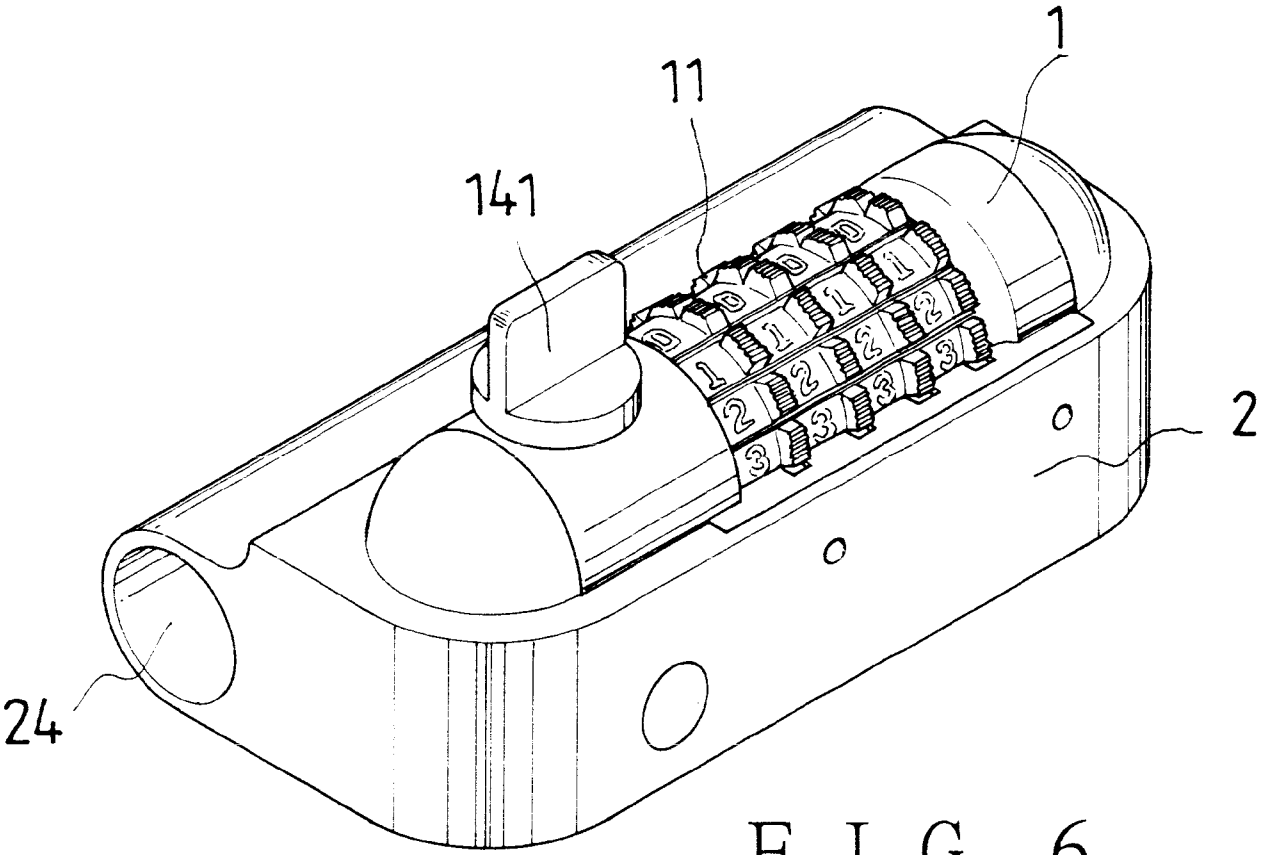
FIG. 6 is a perspective view of the combination lock in FIG. 1.

When the numeral discs 11 are turned to the unlocking position to unlock the lock, referring to FIGS. 4 and 5, the toothed rod 12 is movable in the main body 1, permitting the turnable rod 14 to be turned from the operated part 141. An arc portion of the pushing block 145 will push the engaging rod 22 rearwards to disengage the engaging end 222 from the locking teeth 31 of the locking rod 3. Thus, the steering wheel lock is unlocked.

Figure 7:
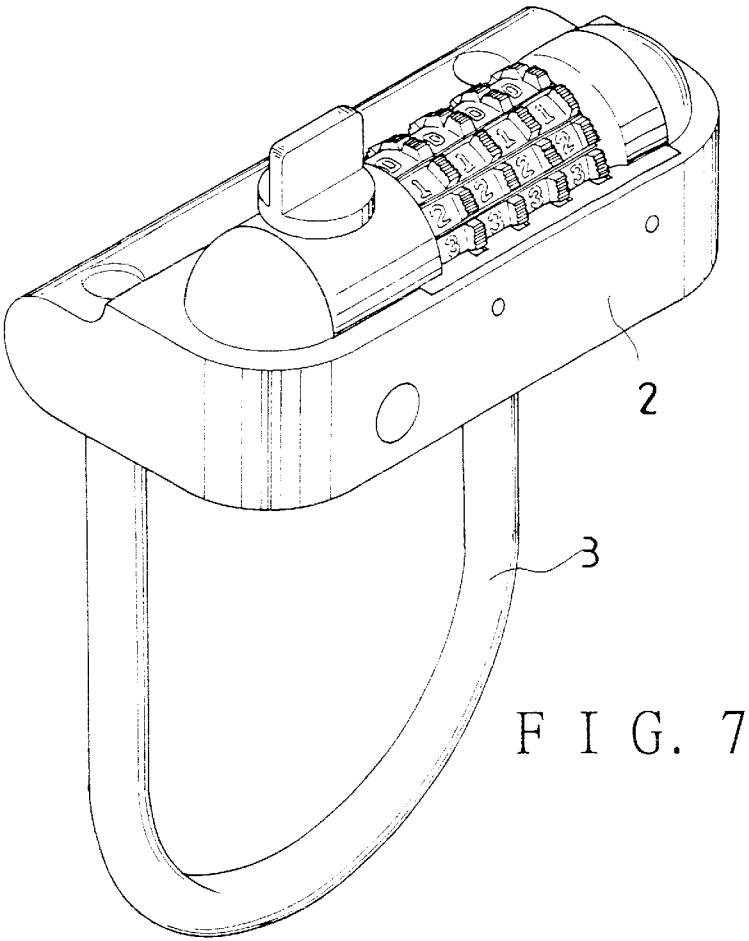
FIG. 7 is a perspective view of the combination lock according to the second embodiment of the present invention.
Figure 8:
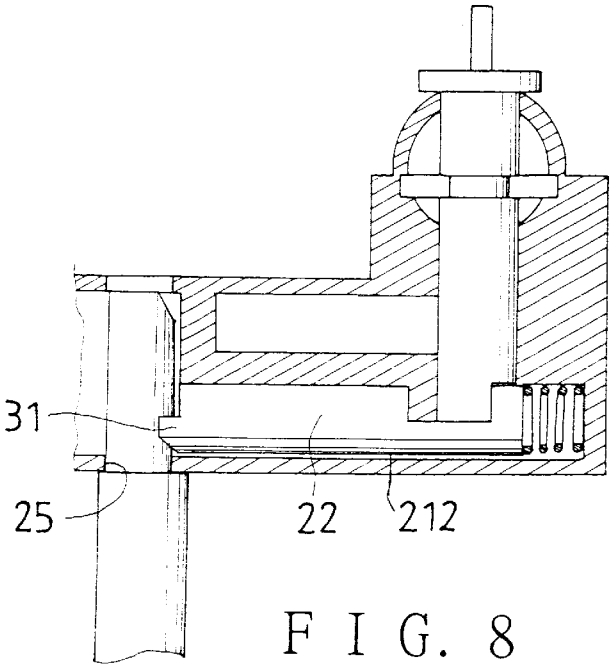
FIG. 8 is a cross-sectional view of the combination lock in FIG. 7.
Figure 9:
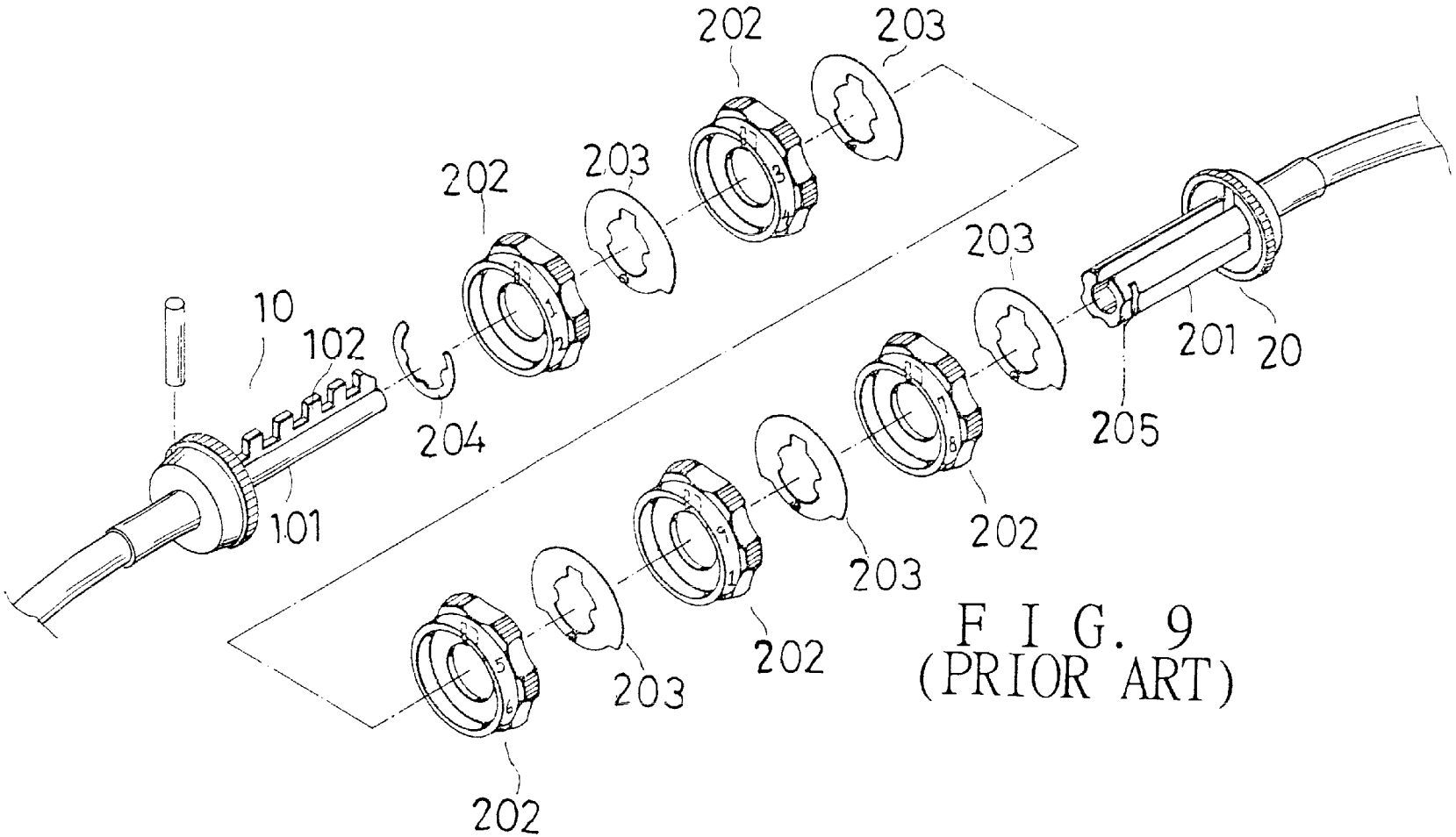
FIG. 9 (PRIOR ART)
FIG. 9 is an exploded perspective view of the conventional combination lock in the Background.

Referring to FIGS. 7 and 8, in a second embodiment of the present invention, the housing part 2 has a first and a second locking rod holes 25; the first locking rod hole 25 is in communication with the second through hole 212 (FIG. 1). An U-shaped locking rod 3 having an engaging trench 31 at one end is inserted into the locking rod holes 25 from two ends with the engaging trench 31 engaging the engaging end 222 of the engaging rod 22 when the lock is locked.

From the above description, the combination lock of the present invention can be known to have an advantage that it can be combined with locking rods of various locks to provide a keyless convenient lock.

What is claimed is:

1. A combination lock, comprising:

a lock main body, said lock main body having a plurality of turnable numeral discs each having a gap on an inner side corresponding to a corresponding unlocking number, said lock main body having a receiving room communicating with said numeral disc inner sides and a plurality of through holes;

a toothed rod passed through said receiving room and said numeral discs; said toothed rod having engaging teeth spaced apart on an upper side; said toothed rod being stopped from moving by said numeral discs engaging said engaging teeth when said numeral discs are turned off said unlocking numbers to a locking position; said toothed rod being movable in said main body when said numeral discs are turned to an unlocking position according to said unlocking numbers for said gaps to form a passage for said engaging teeth; said toothed rod having a separating wall on an outer end, and a protruding plate on an outer side of said wall; said toothed rod being biased outwards by an elastic member;

a housing part fixedly receiving said lock main body in a holding room; said housing part having a first hole aligned with said plurality of through holes of said lock main body; said housing part having a second through hole perpendicular to, and in open communication with said first hole;

an engaging rod movably received in said second through hole; said engaging rod having a front engaging end and an intermediate recessed portion; said engaging rod being biased forwards by a spring;

a turnable rod turnably passed through said plurality of through holes of said lock main body, and said first hole of said housing member, said turnable rod having an intermediate portion having a flat side abutting said protruding plate of said toothed rod to prevent same from turning when said numeral discs are in said locking position; said turnable rod having a lower end pushing block having substantially semi-circular shape, received in said recessed portion of said engaging rod; said pushing lock pushing said engaging rod rearwards when said turnable rod turns under said unlocking position of said numeral discs, permitting said front engaging end of said engaging rod to retreat;

said housing part having a locking rod hole in open communication with said second through hole for permitting a toothed locking rod to be passed therethrough, separably engaging said engaging end of said engaging rod.

2. The combination lock as claimed in claim 1, wherein said turnable rod has an operated part on a top end for permitting a user to turn the turnable rod therefrom.

3. The combination lock as claimed in claim 1, wherein said locking rod hole is formed lengthwise on said housing part.

4. The combination lock as claimed in claim 1, wherein said housing part has a second locking rod hole parallel to said locking rod hole for permitting an U-shaped locking rod to be passed through said rod holes from two ends; said U-shaped locking rod having an engaging trench separably engaging said engaging end of said engaging rod.

* * * * *